US006068082A

United States Patent [19]

D'Amico, Jr. et al.

[11] Patent Number: 6,068,082

[45] Date of Patent: May 30, 2000

[54] MUFFLER PACKING METHOD AND APPARATUS

[76] Inventors: John D'Amico, Jr., 4554 Ash Dr., Nazareth, Pa. 18064; Jeffrey M. Newman, 130 Freedom Ct., Bethlehem, Pa. 18020; Brett A. Rigney, 782 Executive Blvd., Delaware, Ohio 43015

[21] Appl. No.: 08/975,910

[22] Filed: Nov. 21, 1997

[51] Int. Cl.[7] ..... F01N 1/24; B21K 29/00

[52] U.S. Cl. ..... 181/256; 181/256; 29/890.08

[58] Field of Search ..... 181/224, 227, 181/228, 252, 256, 257, 258, 269, 272, 282; 29/890.08

[56] References Cited

U.S. PATENT DOCUMENTS

| | | | |
|---|---|---|---|
| 1,554,534 | 9/1925 | Straussler | 181/282 |
| 2,185,584 | 1/1940 | Boyce | 181/252 |
| 4,167,986 | 9/1979 | Conway | 181/224 |
| 4,324,314 | 4/1982 | Beach et al. . | |
| 4,361,423 | 11/1982 | Nitz . | |
| 4,580,656 | 4/1986 | Fukuda | 181/252 |
| 4,589,517 | 5/1986 | Fukuda . | |
| 4,673,058 | 6/1987 | Roberts et al. . | |
| 4,700,806 | 10/1987 | Harwood . | |
| 4,759,423 | 7/1988 | Harwood et al. . | |
| 4,844,722 | 7/1989 | Ebell . | |
| 4,846,302 | 7/1989 | Hetherington | 181/252 |
| 4,860,853 | 8/1989 | Moring, III . | |
| 4,947,957 | 8/1990 | Cullen et al. . | |
| 5,036,585 | 8/1991 | Schweinfurth | 29/890.08 |
| 5,428,194 | 6/1995 | Emrick et al. . | |
| 5,563,385 | 10/1996 | Harwood . | |

*Primary Examiner*—Khanh Dang

*Attorney, Agent, or Firm*—Duane, Morris & Heckscher LLP

[57] ABSTRACT

A loose packing material for the muffler of an internal combustion engine is confined by a mesh, for handling the loose packing as a unit during assembly of the muffler. The openwork nature of the mesh is such that the mesh does not affect the sound or tune of the muffler, such that the original sound of the muffler is the same as its long term sound. The mesh can comprise fiberglass or metal mesh, but preferably includes a heat consumable material such as a thermoplastic polymer. The mesh can be formed as a wholly or partly closed bag with a shape complementary to a muffler cavity, which can be irregular. The heat consumable type of bag is formed by heat sealed seams. The mesh holds the loose packing material clear of peripheral seams or internal points at which structural parts of the muffler are intended to abut. The confined packing and its methods are particularly apt for stamped plate mufflers and are likewise applicable to other forms such as rolled casing and extruded casing muffler structures.

17 Claims, 3 Drawing Sheets

FIG. 4
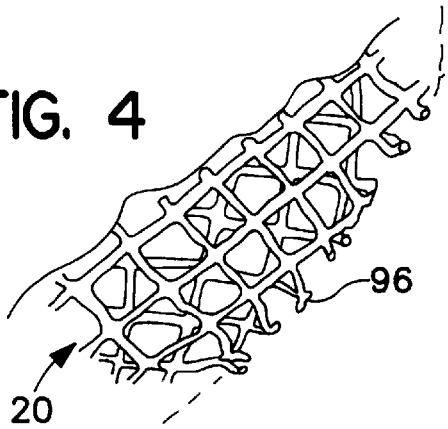
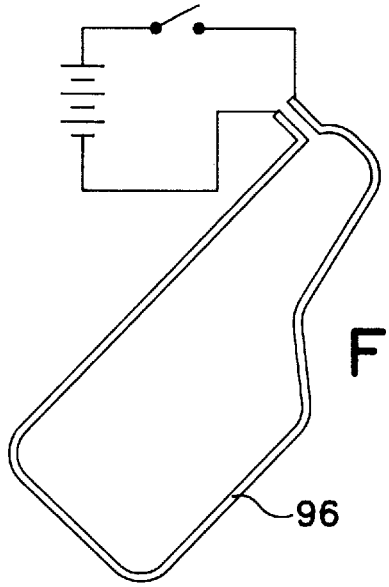
FIG. 5
FIG. 3
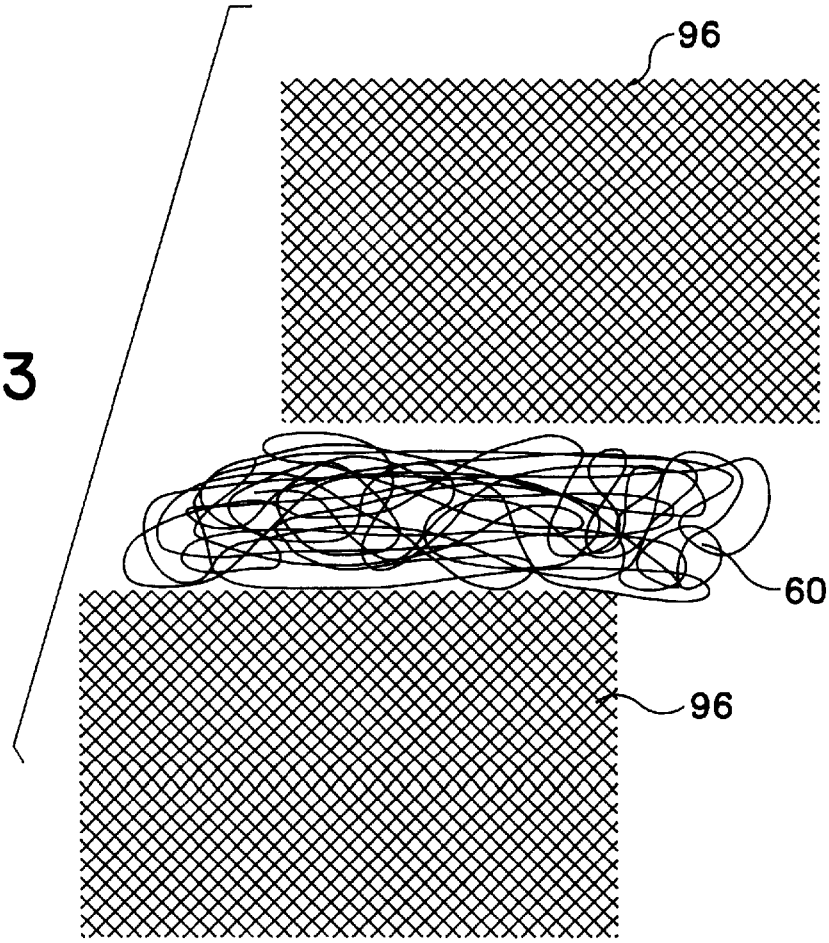

MUFFLER PACKING METHOD AND APPARATUS

BACKGROUND OF THE INVENTION

1. Field of the Invention

The invention relates to the manufacture of mufflers for the exhaust systems of internal combustion engines, and provides an assembly technique and structure that substantially eliminates the break-in or seasoning period associated with conventionally constructed new mufflers. A mass of fibrous muffler packing, especially long or preferably continuous-strand fiberglass, is restrained in size and shape during its permanent enclosure between the walls of a muffler housing, by an open mesh enclosure for facilitating handling and assembly. The mesh preferably comprises a consumable flexible enclosure comprising open net polymer material with heat sealed seams. Alternatively, a similar preparatory enclosure for confining and shaping the packing during assembly can be made from fiberglass, steel, aluminum or copper screening or mesh, or from another open mesh material such as a textile fiber.

The flexible enclosure holds or compresses the packing to clear the seams between the walls and/or internal plenums of the muffler housing, especially during welding. The enclosure also holds the loose fiber in a pack, so that it can be dropped in easily as a unit during muffler assembly. In addition to facilitating the handling of the long strand fiberglass packing, the open net form of the enclosure material has little or no acoustic effect. Therefore, the sound or "tune" of the muffler upon initial operation of the engine is substantially the same as its tune long after the polymer has melted or burned away.

2. Prior Art

The primary function of an exhaust muffler is to mute the noise produced by the cylinders of an internal combustion engine. This is accomplished by placing a sound absorbing muffler packing, typically comprising fibers, in at least one cavity in a muffler housing disposed along the exhaust path. Sound vibrations are absorbed in the circuitous paths between the fibers and by resilient deflection of the fibers, which typically comprise a flexible heat and corrosion-tolerant material such as fiberglass.

Mufflers do not reduce the emitted engine noise to zero. A muffler is structured so as to have a desired effect on the tonal qualities of the sound emitted by the engine. Some mufflers, for example those of performance automobiles, are deliberately made louder or lower pitched than others, for example those of luxury cars. Resonances due to the size and shape of flowpaths defined by walls and plenums through the muffler housing, the path of the exhaust gases through the housing, and as modified by the packing material, are exploited to obtain the desired sound.

A conventional muffler housing has a generally cylindrical external shape, or for mounting under the vehicle chassis often is flattened to have an oblong cross section or a flattened cylindrical shape for better vertical clearance. In manufacturing mufflers, it is necessary to form and to assemble the necessary external and internal walls and plenums, and to assemble them together with the muffler packing so that the muffler packing is confined within the walls.

In a typical muffler construction, inlet and outlet tubes are coupled to opposite ends of a housing. Within the housing, the tubes and the housing walls define various chambers leading generally in a zigzag path whereby exhaust gases circulate in the muffler. At least one chamber or tube is disposed adjacent to or within another chamber or tube with one or more perforated walls. Packing material is compressed into one of these chambers or tubes and the other defines a gas flow path.

Advances in muffler design have included a muffler housing with shallow stamped upper and lower elongated bowl shaped half shell members and one or more internal plates or walls dividing the internal volume, for example substantially along the seam between the upper and lower members. The seam can be welded and/or formed by bending flanged edges of the upper and lower members over one another. A circuitous path is defined between the internal wall and the upper and lower members, with fibrous packing compressed between the internal wall and the upper or lower member on the respective side. Stamped plate mufflers are available from AP Parts Manufacturing Company of Toledo, Ohio. Such mufflers are disclosed, for example, in U.S. Pat. Nos. 4,700,806—Harwood; U.S. Pat No. 4,759,423—Harwood et al.; 4,860,853—Moring III; 5,428,194—Emrick et al.; and, 5,563,385—Harwood, which are hereby incorporated. The present invention is applicable to such stamped plate mufflers and also to more traditional structures, for example having a perforated pipe passing through a cylindrical external housing wall having a tubular chamber confining packing between the perforated tube, the outer wall and annular end plates.

Assembly steps involving stamped plate mufflers can require placement of the packing material in one or more of the wall or plenum structures and compression of the packing into a particular area and shape when attaching other wall or plenum structures. For example, in a stamped plate muffler the packing may be placed in a portion of one half shell adjacent to a gas flow path and compressed under an intermediate plate. The assembly is then flipped over onto the other half shell, which may also have packing placed at a particular chamber therein. It can be difficult to effect such a procedure while properly placing the packing material and without the packing material interfering with the respective seams as it is compressed.

A good material for muffler packing is fiberglass strands. Preferably, long strand or even continuous strand fiberglass is shaped into a mass and compressed as necessary to complement the housing cavity. Strand material is readily restrained from migration into the exhaust stream by one or more panels crossing the flowpath or bounding the flowpath, having spaced holes, slots or other openings to allow gas flow. For long strand loose packing, relatively large holes and slots are sufficient to restrain the packing because they are still small in comparison to the length of the strands and in comparison to any loops which protrude from the packing mass.

Nevertheless, loose strand packing material can be difficult to shape properly and to distribute evenly in the housing cavity. One method for assisting in assembly is to preform the packing into a fixed shape that is complementary with the housing cavity or portion of a housing cavity in which the packing is to reside. For example, a hardening resin can be applied to the packing, which is then pressed or molded into the required shape. The resin bonds the fibers at points where they touch and/or cross one another. When the resin is cured, the packing holds its shape. The fixed shape of the packing is such that outer walls of the muffler can be attached over the packing and the packing does not tend to come between the parts and interfere with the formation of seams.

Another option for containing fibrous packing is to overwrap the packing on a structural element of the muffler, for example with strapping, plastic sheet or the like. The packing is later covered by an outer structural element. The strapping outwardly confines the packing and prevents interference with seams and the like.

Resin used in preforming the packing, and wrapping material confining loose packing, each result in material other than the packing (namely the confining or shape-holding material) being left in the finished muffler. This material affects the operation of the muffler during initial operation on a vehicle. The confining material can be made to burn away, but nevertheless affects the muffler until it burns away completely to leave the non-consumable fiberglass or other packing. The effect on operation is due to the fact that available flowpaths change over time and the physical characteristics of the fibrous packing, such as the flexibility of the fibers and their freedom to move, change over time. As a result, the sound or tune of a new muffler having such confining material changes over time. Assuming that the muffler is designed to sound best once the confining material burns away, the muffler necessarily is not tuned optimally at the beginning of operation.

SUMMARY OF THE INVENTION

It is an object of the invention to at least partly enclose packing for a muffler or resonator, preferably loose continuous strand fiberglass packing, in an open mesh or net sheet material such that the packing is confined during handling and assembly of the muffler, but the mesh structure does not interfere substantially with gas flow or acoustical properties, and thus has little if any effect on the sound or tune of the muffler.

It is also an object of the invention to enclose the packing in a mesh that is consumable in exhaust heat.

It is another object of the invention to form the mesh sheet so as to compress and conform the packing material to a predetermined shape complementary with internal cavities in the muffler.

It is another object of the invention to facilitate forming of the mesh sheet into substantially closed bags by heat sealing edges defining the predetermined shape.

BRIEF DESCRIPTION OF THE DRAWINGS

The above and other objects, features and advantages of the invention will be apparent from the following description of preferred embodiments and examples in conjunction with the accompanying drawings, wherein:

FIG. 3 is an exploded view showing assembly of the muffler packing.

FIG. 4 is an enlarged partial perspective view showing a formed seam in the polymer net bag of the muffler packing.

FIG. 5 is a schematic illustration of a device for forming a perimeter seam as shown in FIG. 4.

DETAILED DESCRIPTION OF PREFERRED EMBODIMENTS

Figure 1:
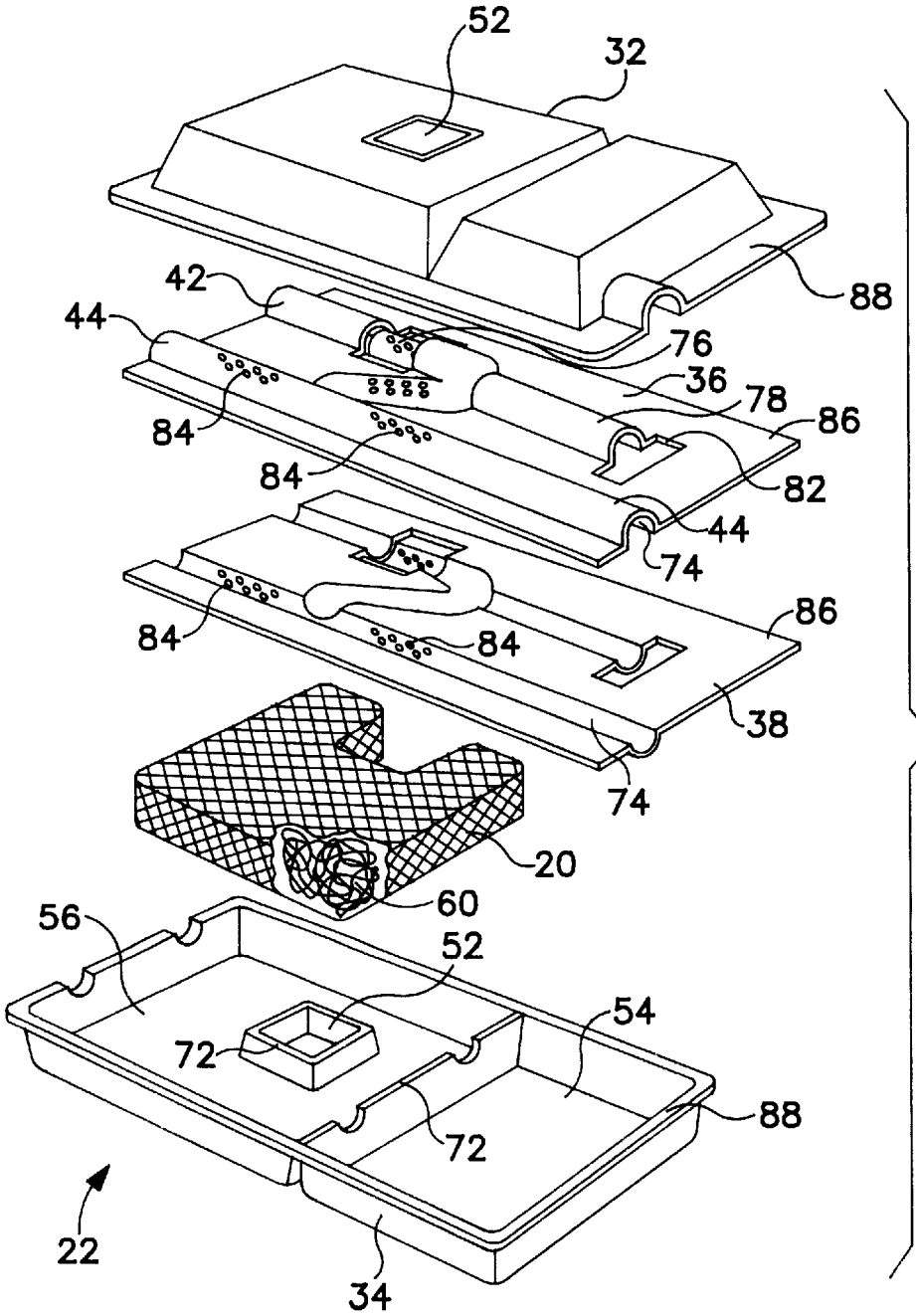
FIG. 1 is an exploded perspective view showing an exemplary stamped plate muffler employing a muffler packing according to the invention.

FIG. 1 shows a muffler construction with packing confined in a polymer net bag 22 according to the invention. The muffler 22 in this example comprises a number of stamped plates, namely two external casing members 32, 34 and two intermediate members 36, 38, which are complementary and when assembled in registry form a number of passageways 42, 44 and a number of chambers 52, 54, 56. At least one chamber 56 contains a sound damping fibrous muffler packing material 60. The stamped plates can be of the type disclosed in U.S. Pat. No. 4,700,806—Harwood, which is hereby incorporated.

Briefly, when abutted together the internal plates 36, 38 define an inlet passage 42 leading to two outlet passages 44 and communicating with several chambers that are dimensioned to provide acoustic effects. The chambers are subdivided by walls formed by raised portions 72 of the stamped plates. These portions 72 as well as the peripheral edges of the plate abut one another when the muffler 22 is assembled and are shaped to provide clearance for the passages formed by elongated channels 74 in the intermediate plates 36, 38. In the embodiment shown, a high frequency chamber 52 is disposed along the inlet channel 42 at one end of muffler 22 and is coupled to the inlet channel via a number of spaced holes 76. A larger low frequency chamber 54 is defined substantially by the outer casing members 32, 34 and is coupled by a passageway 78 and a larger opening 82 to the inlet channel 42.

Along one or more of the passageways for the exhaust gases, openings 84 are provided in one or both intermediate plates 36, 38 leading into the chamber 56 containing the muffler packing 60. Muffler packing 60 comprises a non-consumable fibrous material such as fiberglass, and most preferably long or continuous strand fiberglass that is compressed in place. According to an inventive aspect, this muffler packing 60 is loose material confined at least during assembly and for a time after assembly by an openwork mesh or net 20 rather than by a consumable sheet or resin. Whereas mesh 20 is an openwork structure confining the packing and the packing consists of non-consumable loose strands, it has substantially no effect on the sound or tune of muffler 22.

The mesh confines the packing and can be made of various materials that are formable into a net, mesh or very loose weave, such as polyethylene, polypropylene, nylon, or natural fiber. Alternative materials include fiberglass mesh, steel, aluminum or other metals and the like. This latter group is not readily consumable, but can form an enclosure that confines and shapes the packing to facilitate handling and assembly steps, without affecting the packing acoustically due to the open mesh form of the material. According to a further inventive aspect, mesh 20 preferably is made of a consumable material such as a thermoplastic polymer (e.g., polyethylene, polypropylene, nylon or the like), a consumable textile fiber, etc. As a further alternative, mesh 20 can be made partly from consumable material and partly from non-consumable material. This alternative is appropriate, for example, when the mesh is to be shaped to include a sharp corner or the like, which may be difficult to achieve using a more flexible polymer mesh.

Mesh 20 retains the packing material 60 during assembly of muffler 22. In a stamped plate structure, for example, the plates can be attached by welding or folding into a bead at a perimeter seam including the edges 86 of the internal plates 36, 38 and the flanged edges 88 of the external plates or casing members 32, 34. Mesh 20 keeps packing 60 clear of the seams at the edges 86 and flanges 88 and facilitates assembly. Similarly, in an embodiment in which the muffler comprises a generally cylindrical outer casing surrounding a perforated exhaust gas tube and closed by end plates (not shown), mesh 20 can define a tubular shape for the packing, which is dropped or inserted into the muffler before attaching one of the end plates.

According to another aspect, the mesh is formed as a substantially closed enclosure or bag. Although a mesh sheet could be placed over loose packing to keep it clear of the seams, a mesh bag 20 is preferred because it provides an effective means to confine and shape packing material 60 and to handle it as a unit. As shown in FIG. 1, the mesh bag 20 can pre-shape the loose packing material 60 to an irregular shape, such as the U-shape shown, to remain clear of internal structures that are intended to abut directly, such as the standing edges of the portion of bottom casing member 34 forming part of the high frequency resonant chamber 52 as shown. The mesh bag can also conform the packing to other shapes such as constrictions, bends and the like.

Mufflers and muffler chambers come in various shapes as needed to fit in available space on or under an automobile or the like. Various shapes for the packing are readily produced by appropriately shaping mesh bag 20. In the alternative embodiment of FIG. 2, for example, the invention is applied to a muffler or resonator having a tapering shape. Only one intermediate plate 38 and bottom casing member 34 are shown, using the same reference numbers as in the other figures to identify corresponding structures.

Figure 2:
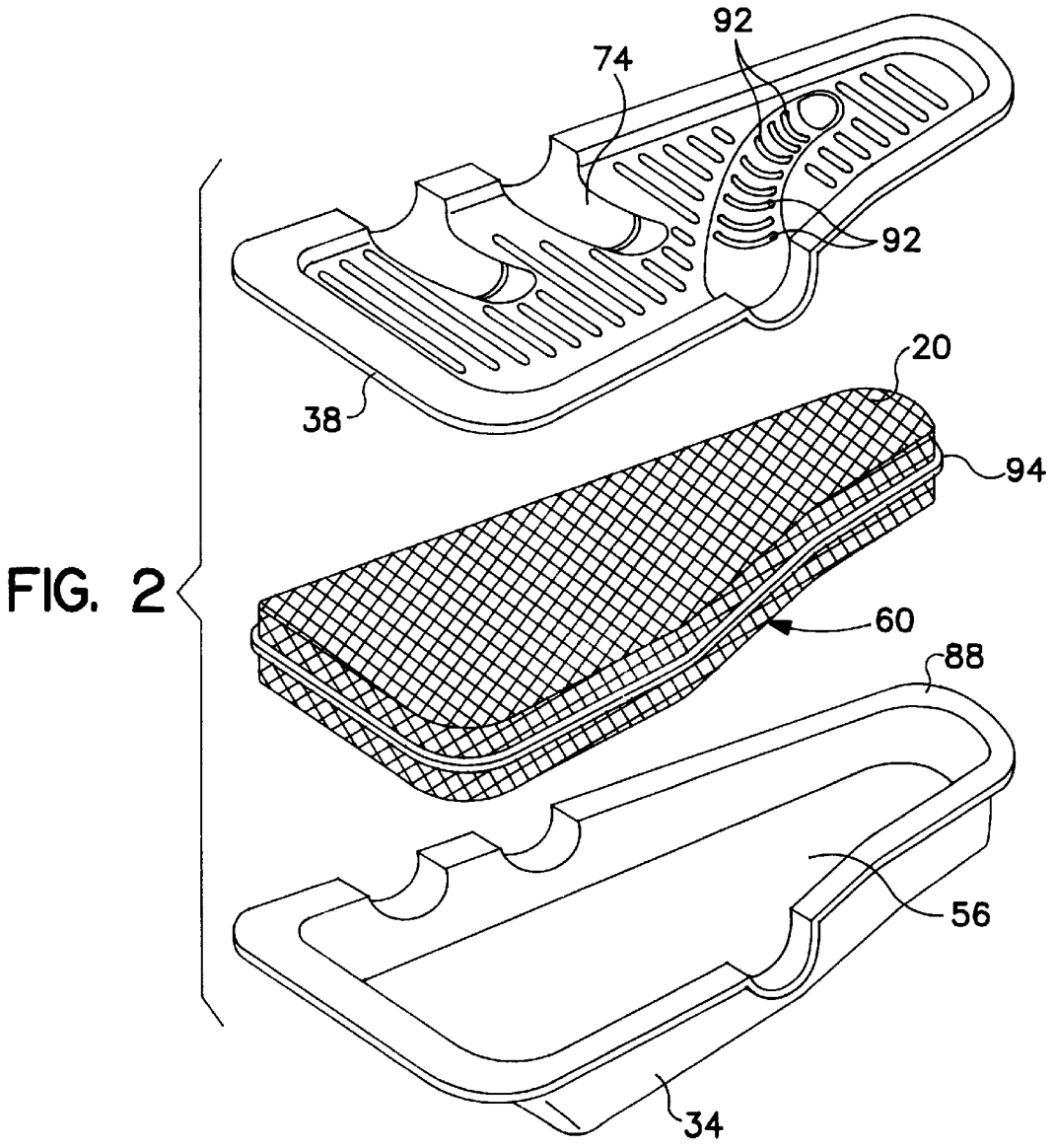
FIG. 2 is an exploded perspective view illustrating a casing member, muffler packing and internal plate according to an alternative embodiment.

The mesh enclosed packing 60 in FIG. 2 is in a continuous block. This form of muffler has an inlet having slots 92 leading into the chamber 56 defined between the intermediate plate 38 and the bottom casing member 34 holding the packing 60. Various baffles and interior metal panels may be included in and between the stamped plates to subdivide the volume and the mesh enclosure 20 can be shaped to keep the packing material clear of the seamed edges and any pinch points between the respective parts.

The mesh can be of polymer fiber of one to several millimeters thickness. The size of the mesh opening can vary, but preferably is from one to three centimeters. Square, circular, triangular, hexagonal or other polygonal mesh shapes can be used. The mesh is preferably integral, but could comprise a loose weave or knit of individual fibers.

According to another aspect, the mesh is formed into a bag by sealing sheets 96 of mesh material along at least one seam 94. A central peripheral seam 94 is shown in FIG. 2. Referring to the exploded view of FIG. 3, a quantity of packing material 60 can be placed between two mesh sheets 96, which are then joined. According to a further aspect, the seam can be welded as shown in FIG. 4, wherein crossing and adjacent webs of the mesh material are joined to one another along a line. This can be accomplished by heat welding the thermoplastic material of the mesh. The heat welding can be accomplished, for example, by applying a Teflon coated electrically heated wire 98 to the overlaid edges of mesh sheets 96, melting, fusing and also cutting through the mesh. The heated wire 98 can be shaped to the outline of the chamber 56 in muffler 22 intended to hold the packing 60.

According to an alternative method for making the enclosed muffler packing of the invention, mesh bag 20 can be partially formed and filled with the fibrous packing material through an opening that is optionally sealed thereafter. According to that alternative, a shaped mesh bag is produced and the fiberglass or other non-consumable packing material is blown or dropped into the bag. A measured quantity of packing material is inserted (e.g., by weight). The bag preferably is sized to compress packing material 60 somewhat from its loose state. Also, when assembling muffler 22, casing members 32, 34 and intermediate stamped plates 36, 38 preferably compress packing material 60 further.

The mesh enclosure 20 for packing 60 does not affect the tune of the muffler because the openwork nature of the mesh is such that it does not affect the exhaust gases acoustically. The openings in the mesh are relatively large and the fiber size of the mesh is relatively small compared to the dimensions of the openings 84, 92 between the exhaust gas passageways and the chamber(s) holding packing material 60. In the embodiment using thermoplastic polymer mesh, the mesh burns away during the early use of muffler 22 on a vehicle, and whereas the mesh contains little material in comparison to a more continuous sheet structure, the mesh burns away relatively quickly.

In addition to having the advantages of shaping and confining loose packing material 60 during muffler assembly, the mesh bag 20 of the invention generally makes it easy to handle packing material 60.

The specific muffler structure shown in FIG. 1 is merely an example of various structures to which the invention can be applied. The invention is also applicable to other muffler types, shapes and configurations, such as mufflers in which core elements are disposed within a casing that wraps around the core elements and the packing material. For such a muffler configuration, a mesh enclosure in the form of inner and outer tubes can confine the packing in the annular area between them, being sealed together at the ends. For purposes of this disclosure, that and other such enclosures can also be considered bags.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A sound absorbing packing for a muffler for an exhaust of an internal combustion engine comprising:

a loose muffler packing material;

a mesh at least partly confining the packing material to conform to a cavity of the muffler, the mesh being an openwork structure having a minimal acoustic effect, whereby the muffler has an original tune substantially the same as its long term tune, and wherein the mesh is at least partly made of a consumable material and is consumed by operational exhaust heat of the exhaust of the internal combustion engine with operation of the muffler, leaving substantially only the packing material in the cavity after consumption of the mesh.

2. The packing of claim 1, wherein the mesh is at least partly made of a non-consumable material.

3. The packing of claim 1, wherein the consumable material of the mesh comprises a thermoplastic polymer material.

4. The packing of claim 1, wherein the mesh is formed in a shape of a bag.

5. The packing of claim 4, wherein the bag is substantially closed and conforms the packing to a shape complementary with the cavity of the muffler.

6. The packing of claim 5, wherein the bag is at least partly formed by heat sealed seams in the mesh.

7. In combination, a muffler for an exhaust of an internal combustion engine and a loose packing material, the packing material being at least partly confined by a mesh to conform to a cavity of the muffler, the mesh being an openwork structure having a minimal acoustic effect, whereby the muffler has an original tune substantially the same as its long term tune, and wherein the mesh is at least partly made of a consumable material and is consumed by operational heat of the exhaust of the internal combustion engine with operation of the muffler, leaving substantially only the packing material in the cavity after consumption of the mesh.

8. The combination of claim 7, wherein the mesh is partly made of a non-consumable material.

9. The combination of claim 7, wherein the consumable material of the mesh comprises a thermoplastic polymer material and the mesh is shaped as a bag.

10. The combination of claim 9, wherein the bag is substantially closed and conforms the packing to a chamber of the muffler.

11. In combination, a muffler and a loose packing material, wherein the packing material is at least partly confined by a mesh to conform to a cavity of the muffler, the mesh being an openwork structure having a minimal acoustic effect, whereby the muffler has an original tune substantially the same as its long term tune;

wherein the mesh is at least partly made of a consumable material and is consumed by heat with operation of the muffler, leaving substantially only the packing material in the cavity after consumption of the mesh;

wherein the consumable material of the mesh comprises a thermoplastic polymer material and the mesh is shaped as a bag that is substantially closed and conforms the packing to a chamber of the muffler; and, wherein the muffler comprises a plurality of stamped plates, the plates having protrusions bearing toward one another and wherein the bag is shaped to hold the packing material clear of the protrusions.

12. The combination of claim 11, wherein the protrusions include seams along a peripheral edge of the muffler.

13. A method of manufacturing a muffler comprising the steps of:

providing at least two parts of a muffler casing defining a chamber for a loose packing material, the casing having at least one of a seam and an internal protrusion between the at least two parts;

at least partly confining the loose packing material in a mesh forming an openwork structure at least partly complementary to the chamber;

placing the loose packing material as confined by the mesh between two of said parts of the muffler casing, such that the mesh material holds the packing material clear of said at least one of the seam and the protrusion; and, assembling the two parts of the muffler casing with the confined packing material therein.

14. The method of claim 13, wherein said at least two parts comprise stamped plates.

15. The method of claim 13, further comprising forming the net as a substantially closed bag.

16. The method of claim 13, further comprising forming the bag by heat sealing edges of the net to form at least one seam.

17. The method of claim 13, wherein the mesh comprises a heat consumable material, whereby the mesh is consumed in operation of the muffler leaving substantially only the loose packing material between said parts.

* * * * *